US006027064A

United States Patent [19]

Spahlinger

[11] Patent Number: 6,027,064

[45] Date of Patent: Feb. 22, 2000

[54] TAKEUP MACHINE FOR A CONTINUOUSLY ADVANCING YARN

[75] Inventor: Jorg Spahlinger, Wermelskirchen, Germany

[73] Assignee: Barmag AG, Remscheid, Germany

[21] Appl. No.: 09/077,973

[22] PCT Filed: Oct. 6, 1997

[86] PCT No.: PCT/EP97/05465

§ 371 Date: Jun. 12, 1998

§ 102(e) Date: Jun. 12, 1998

[87] PCT Pub. No.: WO98/16457

PCT Pub. Date: Apr. 23, 1998

[30] Foreign Application Priority Data

Oct. 12, 1996 [DE] Germany ..... 196 42 137

[51] Int. Cl.[7] ..... B65H 18/08

[52] U.S. Cl. ..... 242/481.7; 242/477.3

[58] Field of Search ..... 242/481.7, 477.3

[56] References Cited

U.S. PATENT DOCUMENTS

| | | | |
|---|---|---|---|
| 3,374,961 | 3/1968 | Otsuka et al. | 242/481.7 |
| 4,505,436 | 3/1985 | Schippers et al. . | |
| 4,505,437 | 3/1985 | Schippers et al. | 242/481.7 |
| 4,561,603 | 12/1985 | Schippers et al. | 242/481.7 |
| 4,585,181 | 4/1986 | Schippers et al. | 242/481.7 |
| 4,674,694 | 6/1987 | Hasegawa et al. . | |
| 4,789,112 | 12/1988 | Schippers et al. . | |
| 5,526,995 | 6/1996 | Westrich et al. . | |
| 5,624,081 | 4/1997 | Turk et al. | 242/481.7 |
| 5,887,817 | 3/1999 | Kudrus et al. | 242/481.7 |

FOREIGN PATENT DOCUMENTS

| | | |
|---|---|---|
| 38 26 130 | 2/1989 | Germany . |
| 295 03 084 U | 4/1995 | Germany . |

*Primary Examiner*—Donald P. Walsh
*Assistant Examiner*—Minh-Chau Pham
*Attorney, Agent, or Firm*—Alston & Bird LLP

[57] ABSTRACT

A yarn winding machine and a method of winding a continuously advancing yarn to a package. In this process, a rotary blade type traversing apparatus reciprocates the yarn by oppositely driven rotary blades along a curved guiding edge transversely to the direction of yarn advance. The shape of the guiding edge determines the position of the yarn respectively on the guiding rotary blade, so that the yarn is displaced on the package at a predetermined traversing speed. In accordance with the invention, the configuration or shape of the guiding edge can be varied during the winding, so that the traversing speed is decreased or increased.

14 Claims, 3 Drawing Sheets

TAKEUP MACHINE FOR A CONTINUOUSLY ADVANCING YARN

BACKGROUND OF THE INVENTION

The invention relates to a yarn winding apparatus and method for winding a continuously advancing yarn onto a rotating bobbin to form a yarn package.

A winding apparatus of the described type is known from DE 38 26 130.

In this known machine, the yarn is reciprocated by means of a rotary blade type traversing apparatus along a guide plate with a guiding edge. In such winding machines, a higher mass distribution of the yarn occurs in the region of the stroke reversal, which leads to an elevated edge formation at the package ends. To avoid such bulging accumulations of material at the package ends in the region of the stroke reversal, the guide plate can be changed in its position such as to permit variation of the length of the traverse stroke. As a result of displacing the guide plate, it is accomplished that an earlier transfer of the yarn occurs between the associated, oppositely rotating blades, which leads to a decrease in the traverse stroke.

However, this method brings along the problem that with a shortened traverse stroke, the yarn remains momentarily unguided in the region of the stroke reversal. The displacement of the guide plate results in that the yarn drops from the tip of the guiding rotary blade before reaching the stroke reversal point. The yarn remains now unguided, until the returning rotary blade reaches the yarn. Such unguided situations of the yarn lead to an irregular deposit of the yarn on the package.

Accordingly, it is the object of the invention to further develop a yarn winding machine and a method of the initially described kind such as to permit formation of cylindrical packages without a saddle formation while the traverse stroke remains unchanged.

SUMMARY OF THE INVENTION

The above and other objects and advantages of the present invention are achieved by the provision of a yarn winding apparatus and method which comprises at least two guide arms mounted for rotation about closely adjacent parallel or coaxial axes so that the rotating arms define closely adjacent parallel planes and the extremity of each rotating arm is adapted to pass along the traverse plane, and drive means for rotating each of the arms in opposite directions so that one arm moves in a direction toward one end of the traverse stroke and the other arm moves in the opposite direction toward the other end thereof. A main yarn guide plate is mounted on one side of the traverse plane and defines a main guide edge which extends in a direction generally parallel to the traverse stroke and through the traverse plane in a medial portion of the yarn traverse stroke to thereby guide the yarn and control its traversing speed. Also, the yarn guide member includes means for varying the configuration of the guide edge during the winding operation so as to vary the traverse speed.

In a rotary blade type traversing apparatus, the yarn is displaced along a guiding edge for purposes of equalizing the traversing speed within the traverse stroke. The guiding edge is curved in such a manner that the yarn on the rotary blade is deposited on the package surface at a predetermined traversing speed. In this process, the mass distribution of the yarn on the package is dependent on the respectively adjusted traverse speed. Thus, in accordance with the invention, a variation in the shape of the guiding edge permits adjustment of any desired profile of the traversing speed within the traverse stroke. The special advantage of the invention lies in that it permits winding of cylindrical packages with a uniform package surface. Furthermore, the packages exhibit a uniform hardness over their entire surface.

In a preferred variant of the winding machine, the shape of the guiding edge is changed in the medial region of the traverse stroke. This has the advantage that the stroke reversal points, in which the yarn is transferred between the rotary blades, remain unaffected. During the entire traverse stroke, the yarn is guided at a predetermined traversing speed. Any undefined yarn deposits on the packages are absent. The yarn transfer between the rotary blades occurs always at the same point. As a result, an advantageously straight package edge is formed.

In one preferred embodiment, the change in the shape of the guiding edge is formed by several guide plates arranged in parallel planes. Each of these guide plates has a sectional guiding edge. As a result of moving the guide plates relative to one another, the shape of the guiding edge becomes variable transverse to the yarn path. The special advantage of this arrangement lies in that the mass distribution can be influenced purposely in certain regions of the package surface irrespective of other regions of the package surface. The guiding edge is formed by overlapping the sectional guiding edges. The overlapping regions always exhibit a continuous transition, so that the yarn is not subject to any unevenness, while being guided along the guiding edge.

Two guide plates may be provided, which overlap in the medial region of the traverse stroke. This configuration has the advantage that the mass distribution in one half of the package can be influenced irrespective of the other half of the package. This is especially of advantage, when it comes to influence, besides the mass distribution of the yarn, the guiding speed of the yarn toward the package end. In this instance, it is of advantage, when the yarn is guided at a slowed down traversing speed toward the stroke reversal point, but is then again guided away from the package edge at an increased traversing speed. This measure allows to prevent so-called sloughs.

The further development provides that the guide plates are interconnected such that they require a joint adjustment for changing the shape of the guiding edge. This makes it possible to realize a time-programmed control of the change in the shape of the guiding edge and, further, to achieve with this arrangement an essential shape variation in the medial region of the traversing stroke.

A further advantageous embodiment of the takeup machine provides that the guide plates arranged in parallel planes extend over the entire length of the traverse stroke. This has the advantage that the yarn is guided along a conventionally positioned guide plate. Only for equalizing the mass distribution of the yarn, in particular in the medial region of the traversing stroke, is a parallel arranged guide plate moved transverse to the yarn advance such that the yarn is guided along the sectional guiding edge of the moved guide plate. Since the guide plates with their sectional guiding edges extend over the entire length of the traverse stroke, it is likewise possible to influence the stroke ends such that a stroke is shortened.

The further development provides that at least one of the guide plates extends over the entire length of the traverse stroke, and that another of the guide plates is constructed for movement transverse to the yarn advance. As a result, a simple construction is realized, which makes it possible to perform at predetermined time intervals in particular an equalization of the mass distribution in the medial region of the traverse stroke. In so doing, the movable guide plate is moved with its sectional guiding edge into the plane of the yarn advance to such an extent that the sectional guiding edges of both guide plates intersect in predeterminable transition points. Thus, the advance of the yarn changes in the transition point from the guiding edge of a first guide plate to the sectional guiding edge of a second guide plate. The crossing regions ensure a steady advance of the yarn without a sudden change in the direction of the yarn.

The method of the present invention is characterized in that the yarn can be deposited on the package surface at a desired speed. As a result, it is possible to control the mass distribution of the yarn on the package surface. On the other hand, the laws of movement for forming a cylindrical package with straight edges can be optimized in such a manner that an occurrence of so-called sloughs on the package edges is nonexistent.

BRIEF DESCRIPTION OF THE DRAWINGS

Some of the objects and advantages of the present invention having been stated, others will become apparent as the description proceeds, when considered in conjunction with the accompanying drawings, in which.

DETAILED DESCRIPTION OF THE PREFERRED EMBODIMENTS

Figure 1:
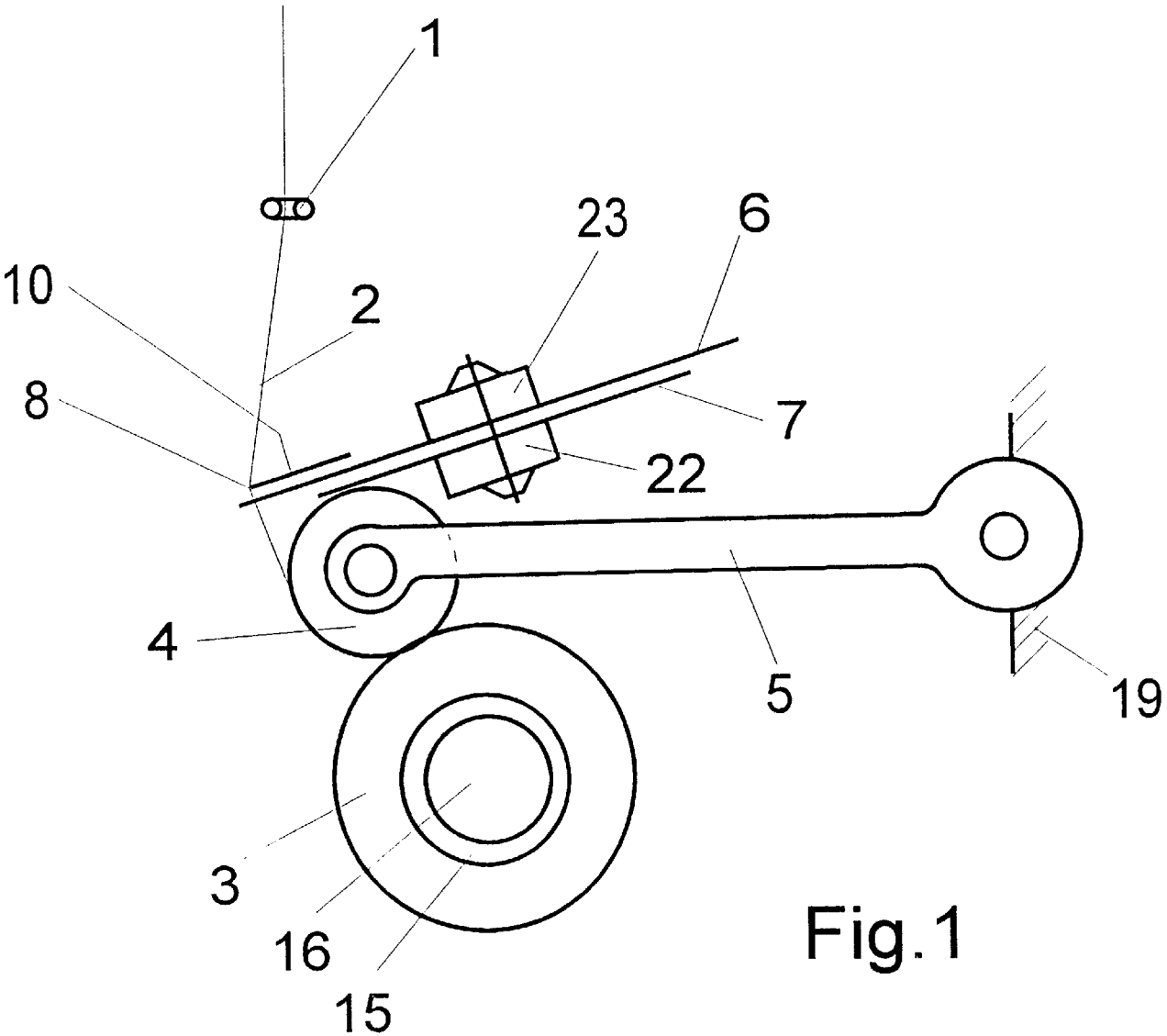
FIG. 1 is a side view of a yarn winding machine.

Shown in FIG. 1 is a side view of a yarn winding machine. In this machine, a yarn 2 advances via an apex yarn guide 1 to a yarn traversing apparatus. The yarn traversing apparatus is of the rotary blade type as is known from and described in detail in EP 0 114 642 and corresponding U.S. Pat. No. 4,505,436. The rotary blade type traversing apparatus comprises rotors 22 and 23, of which rotor 22 mounts a rotary blade 7 and rotor 23 a rotary blade 6. The rotors 22 and 23 are arranged such that the blades 6 and 7 rotate in two closely adjacent parallel planes of rotation. The rotors are driven in opposite directions by means of a traverse drive. In a plane parallel to rotary blades 6 and 7, a guiding edge 8 is formed on a guide plate 10. Below the traversing apparatus, a rocker arm 5 supported in machine frame 19 mounts for rotation a contact roll 4. The contact roll 4 rests under a predetermined pressure against the surface of a package 3. The package 3 is formed on a tube 15. The tube 15 is mounted on a winding spindle 16. The winding spindle 16 is driven by means of a spindle motor (not shown). The spindle speed is controlled such that the circumferential speed of the package remains constant during the winding. To this end, the speed of the contact roll is measured.

In the illustrated winding machine, the yarn 2 advances continuously at a constant speed. Initially, the yarn 2 advances through yarn guide 1, which forms the apex of a traversing triangle. Thereafter, the yarn enters into the rotary blade type traversing apparatus. Rotary blades 6 and 7, which are driven by rotors 22 and 23, rotate in different directions, so that the yarn 2 is guided along the guiding edge 8 of guide plate 10. In so doing, the one rotary blade assumes the yarn advance in the one direction and moves then below the guide plate, while the other rotary blade takes over the yarn advance in the other direction and moves then below the guide plate. Downstream of the traversing apparatus, the yarn is deflected on contact roll 4 by more than 90° and, finally, wound onto package 3.

Figure 2:
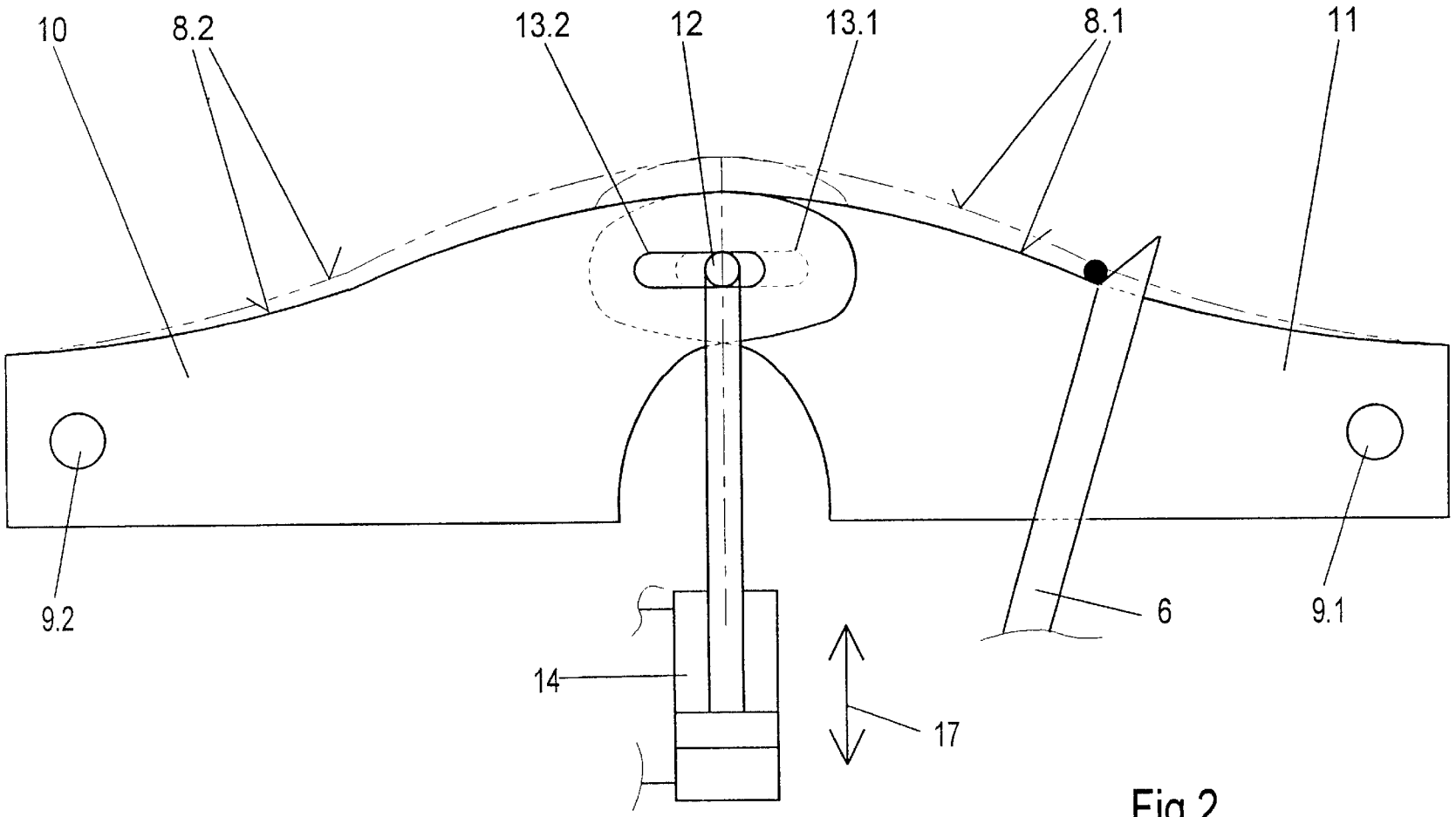
FIG. 2 is a schematic top view of a yarn traversing apparatus with two partially overlapping guide plates.

FIG. 2 illustrates a first embodiment of a yarn traversing apparatus with a variable shape of the guiding edge 8. In this embodiment, the yarn 2 is guided along a sectional guiding edge 8.1 of a guide plate 11 and along a sectional guiding edge 8.2 of a guide plate 10. The guide plates 10 and 11 are arranged in planes parallel to one another. In the end regions of the traverse stroke, the guide plates 10 and 11 are each mounted to swivel joints 9.1 and 9.2. In the medial region of the traverse stroke, guide plates 10 and 11 overlap such that a steady transition is formed between the sectional guiding edges 8.1 and 8.2. In the overlapping region, the guide plates 10 and 11 are each connected to a pin 12 via slots 13.1 and 13.2. The pin 12 is movably supported and coupled with a linear drive 14, so that the pin 12 can be displaced substantially perpendicular to the yarn advance.

The shape of the guiding edge can be changed in that the pin 12 is movable between two end stops. As result of moving the pin substantially crosswise to the guiding edge, the guide plates 10 and 11 move relative to one another such that the sectional guiding edges 8.1 and 8.2 displace substantially perpendicular to the direction of yarn advance. The guiding edge being decisive for traversing is composed of the two sectional guiding edges 8.1 and 8.2. Thus, the guiding edge can assume any desired shape between the illustrated curve and the curve of the guiding edge shown in phantom lines in FIG. 2. The overlapping region of sectional guiding edges 8.1 and 8.2 is laid out such that in any position of guide plates 10 and 11 relative to one another a continuous transition is ensured between the guiding edges 8.1 and 8.2.

Figure 3:
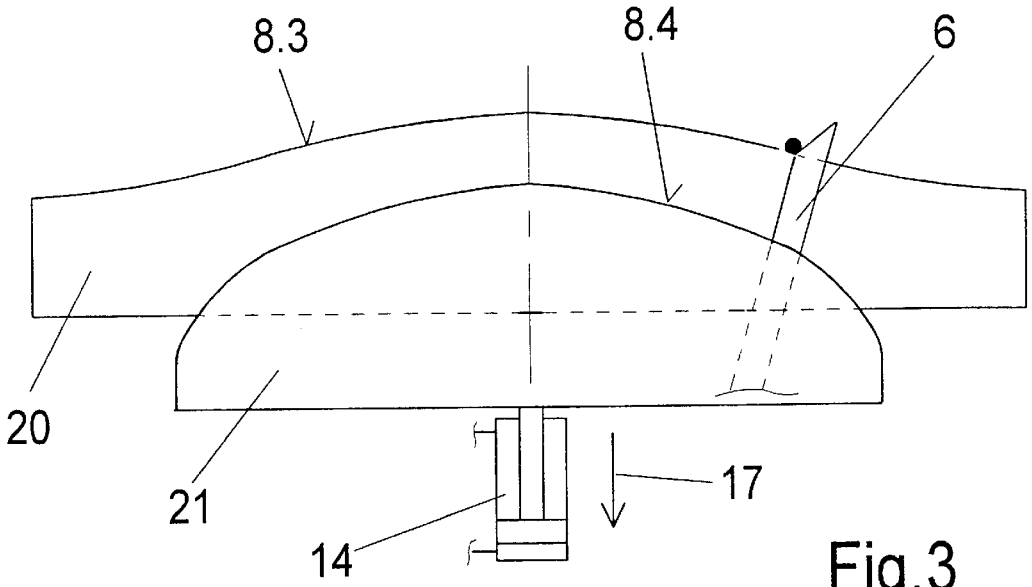
FIG. 3 is a schematic top view of a yarn traversing apparatus having two overlapping guide plates positioned such that their sectional guide edges do not overlap.
Figure 4:
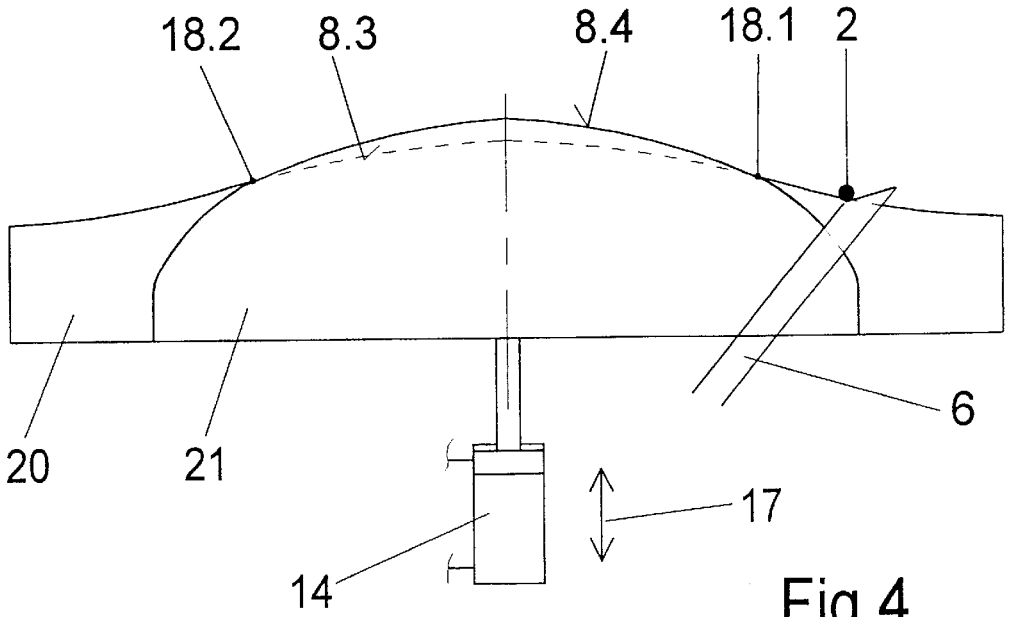
FIG. 4 is a view similar to FIG. 3 but illustrating the guide plates positioned such that their sectional guide edges overlap.

FIGS. 3 and 4 illustrate a further embodiment of the winding machine in accordance with the invention, which comprises a traversing apparatus with a variable guiding edge. In this embodiment, two guide plates 20 and 21 are arranged in planes parallel to one another. The guide plate 20 has a sectional guiding edge 8.3. A guiding edge 8.4 is formed on guide plate 21. The guide plate 21 is mounted for movement relative to guide plate 20 and coupled with a linear drive 14. The linear drive 14 permits displacement of guide plate 21 in direction 17, substantially perpendicular to the yarn advance and parallel to guide plate 20. The yarn 2 is reciprocated within the traverse stroke by means of rotary blades 6 and 7 of the traversing apparatus shown in FIG. 1.

FIG. 3 illustrates a situation, in which the guide plate 21 is displaced such that the sectional guiding edges 8.3 and 8.4 do not overlap. Thus, the yarn is guided only along sectional guiding edge 8.3 of guide plate 20. This shape of the guiding edge is advantageous, inasmuch as the traversing speed in the medial region of the traverse stroke is reduced in comparison with the end regions. As a result, the mass distribution of the yarn is increased in the medial region of the package being formed.

FIG. 4 shows a situation, in which the guide plate 21 is displaced such that the sectional guiding edges 8.3 and 8.4 cross each other respectively in intersections 18.1 and 18.2. Initially, within the traverse stroke, the yarn 2 advances along sectional guiding edge 8.3 of guide plate 20. After the yarn 2 passes intersection 18.1, it continues to advance along sectional guiding edge 8.4 of guide plate 21, until the guiding edge 8.4 recedes again below guiding edge 8.3 in intersection 18.2. Advantageously, the shape of the guiding edge is configured within the traverse stroke in such a manner that the traversing speed is substantially constant over the entire traverse stroke. Thus, the combination of sectional guiding edges 8.3 and 8.4 causes the yarn 2 to advance substantially at the same guiding radius of rotary blade 6 or rotary blade 7. Since the guide plate 21 enters with its guiding edge 8.4 into the yarn advance only in the medial region of the traverse stroke, the transfer points of the yarn between the rotary blades remain unchanged. As a result the traverse stroke is constant during the entire winding cycle.

However, it is also possible that the movable guide plate extends over the entire length of the traverse stroke and, thus, leads likewise to a change of the transfer points in the reversal region of the yarn. This arrangement is of advantage for influencing at the same time the deposit of the yarn at the package ends. Likewise, it facilitates variation of the length of the traverse stroke.

Furthermore, it is possible to construct both guide plate 20 and guide plate 21 for movement. As a result, the shape variation of the guiding edge becomes very flexible, which leads to a great variety of yarn deposits.

At this point, it should be explicitly remarked that the winding machine of the present invention is not limited to rotary blade type traversing apparatus. Instead, it also encompasses such rotary blade type traversing apparatus, in which the yarn is reciprocated over a traverse stroke by means of a plurality of successively arranged rotary blades. In this instance, it will be useful to vary the shape of the guiding edge by several parallel and successively arranged guide plates.

What is claimed is:

1. A yarn winding apparatus for winding an advancing yarn onto a rotating bobbin to form a yarn package, and including traversing means for reciprocating an advancing yarn transversely to its advance direction over a predetermined traverse stroke and so as to define a traverse plane, said traversing means comprising at least two guide arms mounted for rotation about closely adjacent parallel or coaxial axes so that the rotating arms define closely adjacent parallel planes and the extremity of each rotating arm is adapted to pass along the traverse plane, drive means for rotating each of the arms in opposite directions so that one arm moves in a direction toward one end of the traverse stroke and the other arm moves in the opposite direction toward the other end thereof, and a yarn guide member mounted on one side of the traverse plane and defining a guide edge which extends in a direction generally parallel to the traverse stroke to thereby guide the yarn and control its traversing speed, said yarn guide member including means for varying the configuration of the guide edge during operation of the traversing means so as to vary the traverse speed.

2. The yarn winding apparatus as defined in claim 1 wherein the configuration of the guide edge is variable in the medial region of the traverse stroke and not in the end regions of the traverse stroke so that the length of the traverse stroke remains unchanged.

3. The yarn winding apparatus as defined in claim 1 wherein the yarn guide member comprises a plurality of guide plates each having a sectional guide edge and with the plates arranged in parallel planes, and wherein the means for varying the configuration of the guide edge includes means for relatively moving the guide plates so that the sectional guide edges of the plates overlap in a varying configuration.

4. The yarn winding apparatus as defined in claim 3 wherein the yarn guide member comprises two of the guide plates, with each of the guide plates extending over only a partial length of the traverse stroke, and wherein the guide plates overlap in the medial region of the traverse stroke.

5. The yarn winding apparatus as defined in claim 4 wherein the two guide plates are mounted for pivotal movement adjacent respective ends of the traverse stroke, and wherein the two guide plates each include a slot in the medial region of the traverse stroke, with the slots being aligned and receiving a common pin which is selectively moveable in a direction transverse to the traverse plane.

6. The yarn winding apparatus as defined in claim 5 wherein the pin is coupled with a linear actuator.

7. The yarn winding apparatus as defined in claim 3 wherein the yarn guide member comprises two of the guide plates, with the sectional guide edges of each guide plate extending generally in the direction of the traverse stroke and along at least a substantial portion of the length thereof, and wherein at least one of the guide plates is selectively moveable in a direction transverse to the traverse plane.

8. The yarn winding apparatus as defined in claim 7 wherein the sectional guide edge of one of the guide plates extends over the entire length of the traverse stroke, and wherein the other guide plate is selectively moveable in a direction transverse to the traverse plane.

9. The yarn winding apparatus as defined in claim 8 wherein the other guide plate is coupled to a linear actuator so as to be moveable between an extended position wherein the advancing yarn slides along the sectional guide edge thereof within the medial portion of the traverse stroke, and a withdrawn position wherein the advancing yarn does not engage the sectional guide edge thereof.

10. A method of winding an advancing yarn onto a rotating yarn bobbin to form a cross wound package, comprising the steps of traversing the yarn back and forth along the length of the yarn bobbin so as to define a traverse stroke at a predetermined traversing speed, and periodically decreasing or increasing the traversing speed within the traverse stroke during the traversing step.

11. The method as defined in claim 10 wherein the step of periodically decreasing or increasing the traversing speed includes changing the traversing speed only in the medial region of the traverse stroke.

12. The method as defined in claim 10 wherein the step of periodically decreasing or increasing the traversing speed includes changing the traversing speed along at least substantially the entire traverse stroke.

13. The method as defined in claim 10 wherein the traversing step includes guiding the advancing yarn along a curved guide edge, and wherein the step of periodically decreasing or increasing the traversing speed includes changing the curvature of the guide edge.

14. The method as defined in claim 13 wherein the step of changing the curvature of the guide edge includes providing a plurality of guide plates which are relatively moveable relative to each other, and moving the guide plates relative to each other in a controlled sequence.

* * * * *